US006257992B1

(12) United States Patent
LeBlanc

(10) Patent No.: US 6,257,992 B1
(45) Date of Patent: Jul. 10, 2001

(54) SPORT IMPLEMENT WITH HINGED SHAFT

(76) Inventor: Marc-André LeBlanc, 1576 des Pommiers, St-Émile, Quebec (CA), G3E 1E8

( * ) Notice: Subject to any disclaimer, the term of this patent is extended or adjusted under 35 U.S.C. 154(b) by 0 days.

(21) Appl. No.: 09/425,249

(22) Filed: Oct. 25, 1999

(51) Int. Cl.[7] ..... A63B 53/00
(52) U.S. Cl. ..... 473/316; 43/18.1
(58) Field of Search ..... 473/231, 232, 473/233, 295, 558–568, 524, 526, 552, 316; 43/18.1; 280/819

(56) References Cited

U.S. PATENT DOCUMENTS

| | | |
|---|---|---|
| 50,262 | 10/1865 | Monson . |
| 2,159,579 | 5/1939 | Whitney . |
| 2,497,237 | 2/1950 | Reineking . |
| 3,033,575 | 5/1962 | Hause . |
| 3,170,690 | 2/1965 | Goranson et al. . |
| 3,679,205 | 7/1972 | Finkle et al. . |
| 4,511,139 | 4/1985 | Armstrong . |
| 4,555,111 | 11/1985 | Alvarez . |
| 4,763,899 | 8/1988 | Hundley . |
| 4,854,585 | 8/1989 | Koch et al. . |
| 4,889,343 | 12/1989 | Nielsen . |
| 5,205,561 | 4/1993 | Lux . |
| 5,226,652 | 7/1993 | Sato . |
| 5,338,035 | 8/1994 | Lydord . |
| 5,439,219 | 8/1995 | Vincent . |
| 5,496,028 | 3/1996 | Chien . |
| 5,516,097 | 5/1996 | Huddleston . |
| 5,551,691 | 9/1996 | Harada et al. . |
| 5,632,692 | 5/1997 | Lebovici . |
| 5,665,010 | 9/1997 | Mori . |
| 5,728,008 | 3/1998 | Howard . |
| 5,735,753 | 4/1998 | Hoffmeyer . |
| 5,816,929 | 10/1998 | Koch et al. . |
| 5,842,808 | 12/1998 | Potter et al. . |

*Primary Examiner*—Jeanette Chapman
*Assistant Examiner*—Stephen L. Blau
(74) *Attorney, Agent, or Firm*—F. Martineau

(57) ABSTRACT

The sport implement, more particularly a golf club, has a shaft with a flexible joint dividing the shaft in at least two sections. The joint includes first and second sleeve members receiving and secured to the respective shaft sections. An abutment member defining two flanges normal to each other extends from and is secured to the first sleeve member. The second sleeve member fits into the abutment member when the two shaft sections are aligned and an elastic member interconnects the two sleeve members to allow pivoting of the second sleeve member in any plane away from said two flanges and to bias the two shaft sections into alignment. Flexing is made easier in a plane at 45° to said two flanges than in planes normal to the same. The invention concerns more particularly a golf club with the flexible joint adjacent the hand grip. A whipping effect is achieved in the down swing considerably accelerating the club head with a greater golf ball distance and more accurate ball direction being obtained then with a conventional golf club.

11 Claims, 7 Drawing Sheets

FIG.10
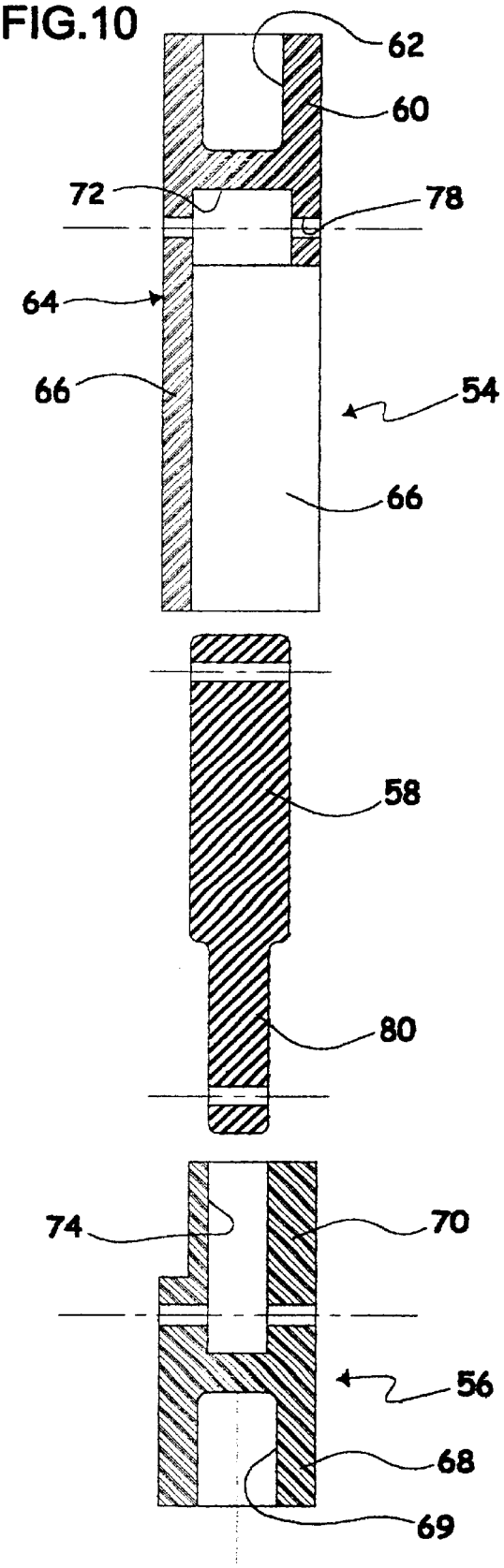
FIG.11
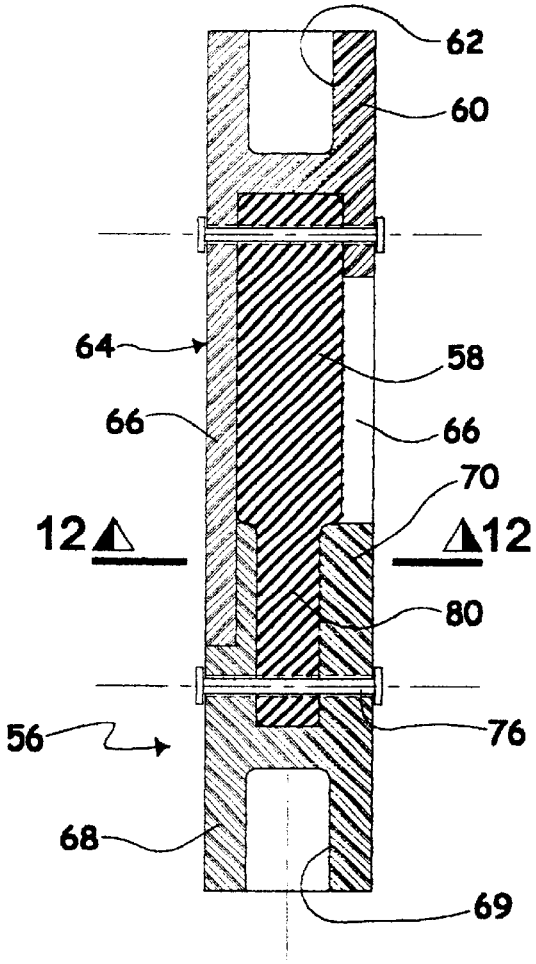
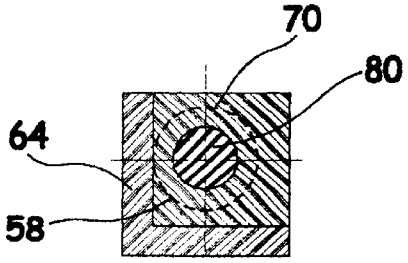
FIG.12

SPORT IMPLEMENT WITH HINGED SHAFT

FIELD OF THE INVENTION

The present invention relates to a sport implement with a hinged shaft, such as a fishing rod and more particularly a golf club.

BACKGROUND OF THE INVENTION

It is known to provide a golf club with a hinged shaft more particularly a practice golf club such as described in U.S. Pat. No. 5,338,035 dated Aug. 16, 1994 (inv.: Keith S. Lyford), entitled "PRACTICE GOLF CLUB". This patent describes a golf club used for practice and comprising upper and lower shaft sections connected by a one way hinge which allows pivoting of the club head in a plane which is about 45° with respect to a reference plane in which the club face has a 0° loft, so that during use of this practice club, the hinge will pivot mirroring the correct wrist position of the golfer during a correct golf stroke. During the back swing of a correct swing, the hinge will brake and remains so pivoted through most of the down swing, accordingly, unless a golfer's wrist are properly positioned during the back swing, the hinge will not pivot. It is obvious that this patent describes a golf club which is used for practice and not for regular golfing in as much as it only pivots provided the golfer's wrist are properly positioned during the back swing.

U.S. Pat. No. 2,497,237 dated Feb. 14, 1950 (inv.: W. Reineking), entitled "PRACTICE TYPE GOLF CLUB". This patent also describes a golf club used for practice with a one way hinge in the shaft, the hinge located just below the hand grip and allowing pivoting of the lower club head carrying shaft section in a plane at 0° with respect to the above defined reference plane. Therefore, the golf club of this patent acts in a way contrary to the Lyford patent in as much as pivoting of the lower shaft section occurs during the back swing only when the golfer's wrists are improperly positioned. Here again, the one way hinge only allows pivoting the lower shaft section in one plane and depending on the proper position of the golfer's wrists during the back swing.

U.S. Pat. No. 2,159,579 dated May 23, 1939 (inv. :W. E. Whitney), entitled "GOLF CLUB OR THE LIKE", also relates to a golf club used for improving the effectiveness of the golfer's swing. This patent is similar to the last named patent with the addition of a spring as shown at 15 to bias the lower shaft section to a stop position in alignment with the upper shaft section. Here again, the hinge is a one way hinge.

U.S. Pat. No. 5,728,008, dated Mar. 17th, 1998 (inv. H. S. Howard), entitled "Ball striking device with means for imparting enhanced forward momentum to the ball" describes a golf club shaft made of two sections connected adjacent the club head by an elastomeric joint having a high modulus of resilience to store a maximum of energy which is released during the downswing to increase the ball velocity. Certainly, the joint does not flex under the weight of the club head when the shaft is horizontal.

OBJECT OF THE PRESENT INVENTION

The main object of the present invention is to provide a golf club to be used in the regular game of golf and which has at least two shaft sections hinged together by a joint with a low modulus of resilience, the club to be used by golfers having or not the correct wrist position during the back swing and the joint braking at the top of the backswing under the effect of the gravity of the club head carrying shaft section so as to obtain a whipping effect considerably accelerating the club head with a consequent increase in the traveling distance of the golf ball compared to a conventional golf club.

Another object of the present invention is to provide a golf club of the character described with which greater accurracy of the golf ball direction is obtained.

Another object of the present invention is to provide a golf club which when used, tends to automatically bias the golfer's wrists to the correct wrist position during the back swing and the return forward swing, if the wrists are not already so positioned.

Another object of the present invention is to provide other types of sports implements having a shaft made of at least two sections hinged together by a joint having a low modulus of resilience so as to obtain a whipping effect increasing the travelling distance of an object, such as a fishing lure propelled by a fishing rod made in accordance with the principles of the invention.

SUMMARY OF THE INVENTION

The present invention relates to a sport implement comprising a shaft having a free end, a hand grip formed around the other end of said shaft, said shaft divided into at least a first and a second shaft section, a flexible joint joining said first and second shaft sections, said joint including a first and a second connector member secured to said first and second shaft sections respectively, an abutment member defining two flaring flanges and extending from and secured to said first connector member, said second connector member fitting into said abutment member when said first and said second shaft sections are aligned, and resilient member interconnecting said two connector members, allowing under the effect of gravity exerted on said second shaft section, pivoting of said second connector member in any plane away from said two flanges and biasing said first and second connector members to said aligned position of said shaft sections.

Preferably said resilient member is an elastomeric member.

In one embodiment, said implement is a fishing rod and said resilient member imparts a whipping effect to said second shaft section during a forward swing movement of said first shaft section.

In the preferred embodiment, said implement is a golf club comprising a shaft, a club head secured to one end of said shaft and having a golf ball striking face and a hand grip formed around the other end of said shaft, said shaft divided into at least a first and a second shaft section, a flexible joint joining said first and second shaft sections, said joint including a first and a second connector member secured to said first and second shaft sections respectively, an abutment member defining two flaring flanges and extending from and secured to said first connector member, said second connector member fitting into said abutment member when said first and second shaft sections are in aligned position and a resilient member interconnecting said two connector members and allowing under the effect of gravity exerted on said second shaft section, pivoting of said second connector member in any plane away from said two flaring flanges and biasing under the absence of said effect said first and second connector members to said aligned position of said two shaft sections.

Preferably, said flanges are normal to each other and said first and second connector members are four-sided sleeve members with two adjacent sides of said second sleeve member abutting said flanges when said first and second shaft sections are aligned, and wherein said resilient member is an elastic sheet longitudinally folded, covering and secured to the two remaining adjacent sides of said first and second sleeve members, said elastic member being tensioned to a lesser degree when said second sleeve member is pivoted relative to said first sleeve member in a plane at 45° to said two flanges then in planes normal to said two flanges, whereby said second joint has a maximum flexibility in said 45° plane.

Preferably, said shaft is divided into two shaft sections, a shorter shaft section including said hand grip and a longer shaft section with said club head carried thereby, said flexible joint being adjacent to said hand grip.

Preferably, said second shaft section is most easily pivotable in a plane of approximately 45° relative to a reference plane, said reference plane corresponding to the plane in which the striking face of said club head with a 0° loft would lie.

In another embodiment, said elastic member is a rod like member secured at both ends to said connector members and housed therein when said connector members are aligned and each connector has two separate aligned cavities respectively surrounding and receiving a shaft section and an end portion of said rod like elastic member.

BRIEF DESCRIPTION OF THE DRAWINGS

In the annexed drawings:

FIG. 10 is an exploded view of yet another embodiment of the joint of the present invention;

FIG. 11 is the joint of FIG. 10 in assembled position; and

FIG. 12 is a cross-section taken along line 12—12 of FIG. 11.

DETAILED DESCRIPTION OF THE PREFERRED EMBODIMENT

Figure 1A:
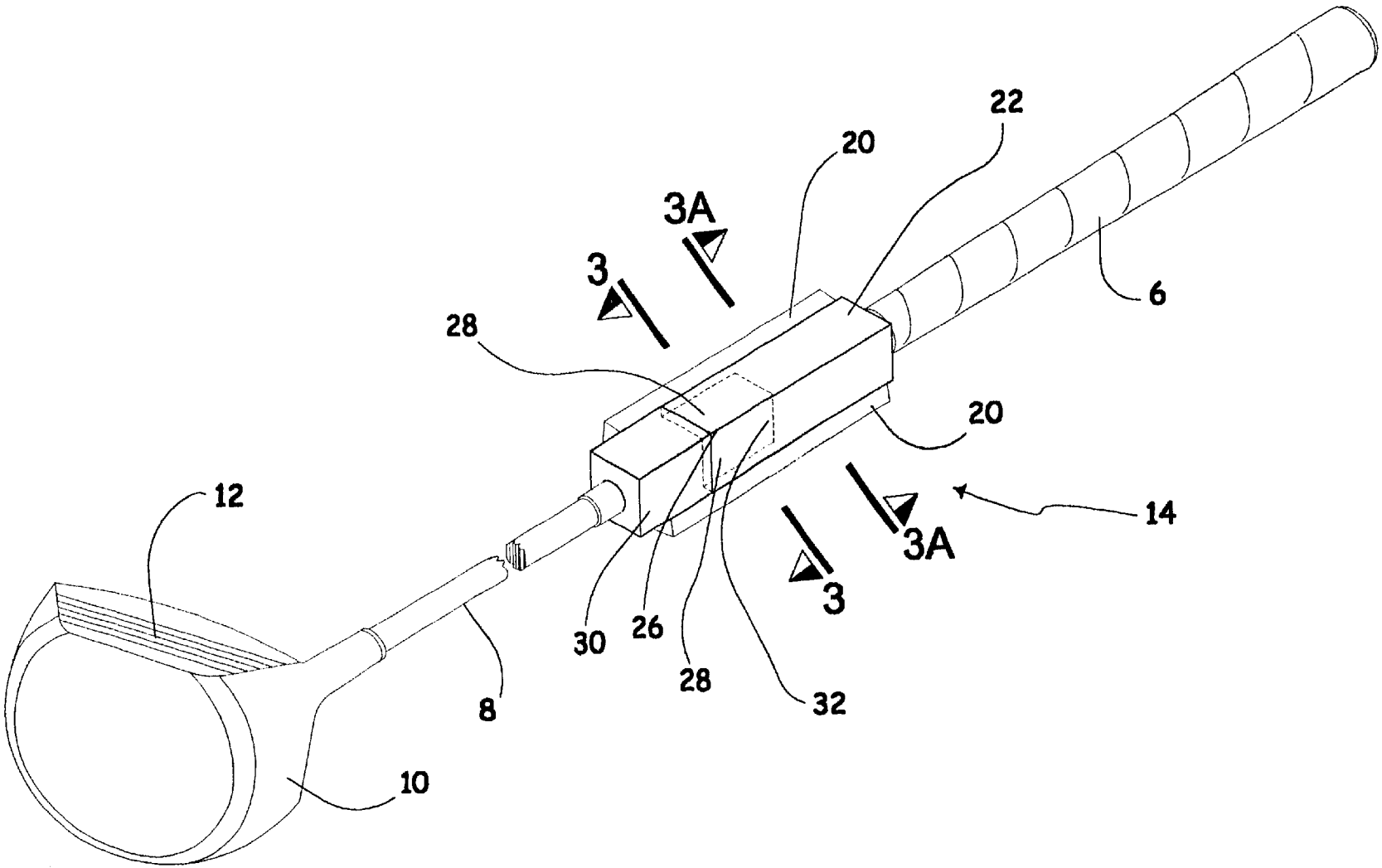
FIGS. 1*a* and 1*b* are perspective views of the golf club of the invention in rest position and pivoted position respectively.

The embodiment shown in FIGS. 1*a*, 1*b*, 2 and 3 is a golf club generally indicated at 2 comprising an upper shaft section 4 surrounded by a hand grip 6 at one end, a lower shaft section 8 to the lower end of which is secured a conventional club head 10 which may be a wood as shown or an iron. The club head 10 has a conventional ball striking face 12 which defines a reference plane supposing the face 12 has a 0° loft.

In accordance with the invention, the shaft has a swivel joint 14 interconnecting the two shaft sections 4 and 8, the joint 14 being located just beneath the hand grip 6. Swivel joint 14 comprises an upper swivel member 16, a lower swivel member 18 and an elastic band 20 joining the two swivel members.

Upper swivel member 16 forms a connector member, preferably a sleeve 22 consisting of a four-sided block in which a blind bore 24 is formed to tightly and security receive the lower end of the upper shaft section 4. A stop member 26 axially protrudes from the sleeve 22, stop member 26 consisting of two flaring flanges 28 preferably normal to each other. Flanges 28 are shown transversely straight but could be transversely curved.

Lower swivel member 18 comprises a connector member, preferably a sleeve 30 in which is formed a blind bore 31 to tightly receive and secure the upper end of the lower shaft section 8. Sleeve 30 is four-sided and is extended by a four-sided block 32 of smaller size than sleeve 30 adapted to abut against the two flanges 28 of the stop member 26 when the two swivel members 16, 18 are aligned. In this aligned position, and under the tension exerted by elastic band 20, the flanges 28 abut against a shoulder 33 formed at the junction of sleeve 30 with block 32 and are flush with the faces of sleeve 30. The inner end faces 22*a* of sleeve 22 and 32*a* of block 32 may also or alternately abut each other.

Figure 2:
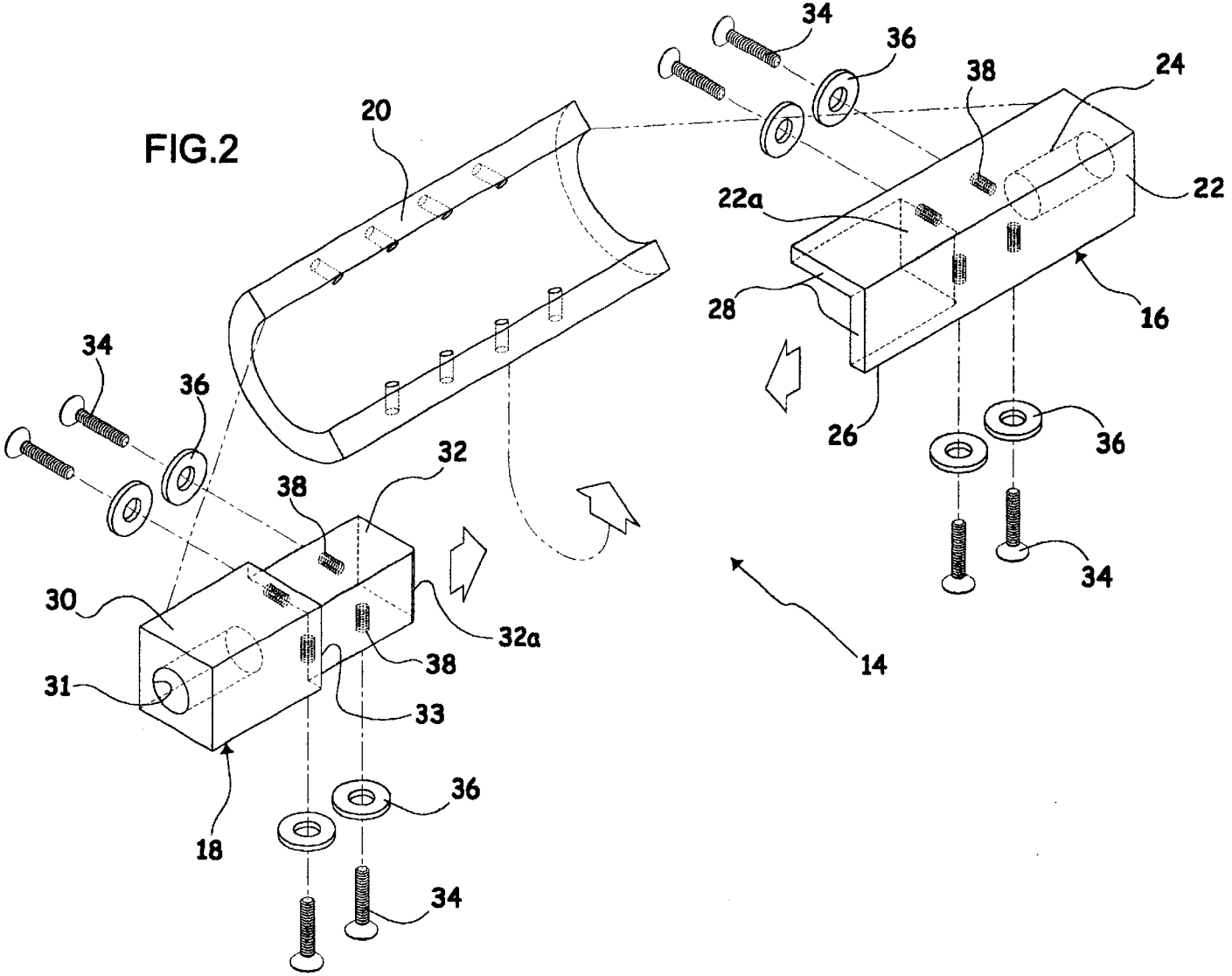
FIG. 2 is an exploded perspective view of the components of the flexible joint of the present invention.

Elastic band 20 is in the form of a relatively thick sheet of elastomeric material, preferably synthetic or natural rubber preferably reinforced by cotton or the like filaments. When in unstreched condition as shown in FIG. 2, it may have a semi cylindrical shape. It overlaps and is secured to the two faces of four-sided block 32 which do not engage flanges 28 and to the corresponding two faces of the four sided sleeve member 22. Band 20 is secured to block 32 and sleeve 22 by bolts 34 screwed in threaded bores 38 and surrounded by washers 36. Band 20 biases the two swivel members into alignment with a return force which is less than the torque exerted by the gravity of lower shaft section 8 and head 10 in a direction to break the joint 14.

Figures 1B, 3:
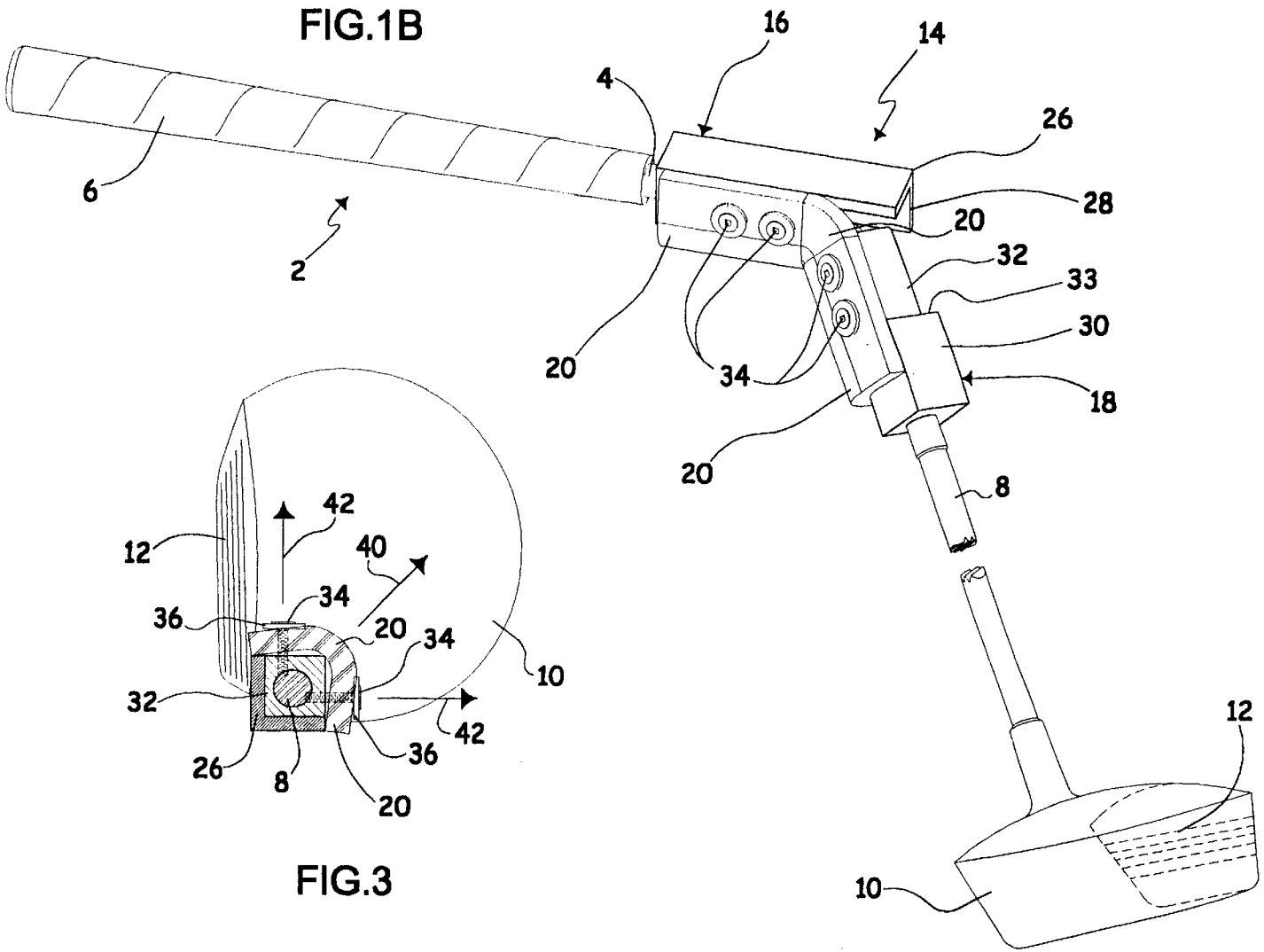
FIG. 3 is a cross-section taken along line 3—3 of FIG. 1*a;*

Band 20 stretches less when lower shaft section is pivoted at 45° relative to flanges 28 than at 90° relative to each the same. Therefore the joint is more flexible along arrow 40 than along arrows 42 as shown in FIG. 3. This 45° maximum flexibility orientation of the joint is correlated with the club head striking face 12 (see arrow 40) for the average golf player such that during a normal swing, the lower shaft section 8 will break when reaching the top of the back swing and hangs down under gravity back of the player for a maximum flexing of the joint. Therefore, during return forward swing, the hand grip 6 accelerates the golf club and the elastic band 20 bias, the lower shaft section towards a position in alignment with the upper shaft section. This aligned position is reached when the four-sided block 32 hits against the stop member 26 which normally is just prior to ball striking. A whipping action is thus achieved in which the club head is accelerated at a much greater velocity than in a swing with a conventional golf club. Upper shaft section 4 travels at the same speed and through the same arc as in a conventional golf club but club head 10 travels through a much greater arc and consequently at a much greater speed.

Figure 8:
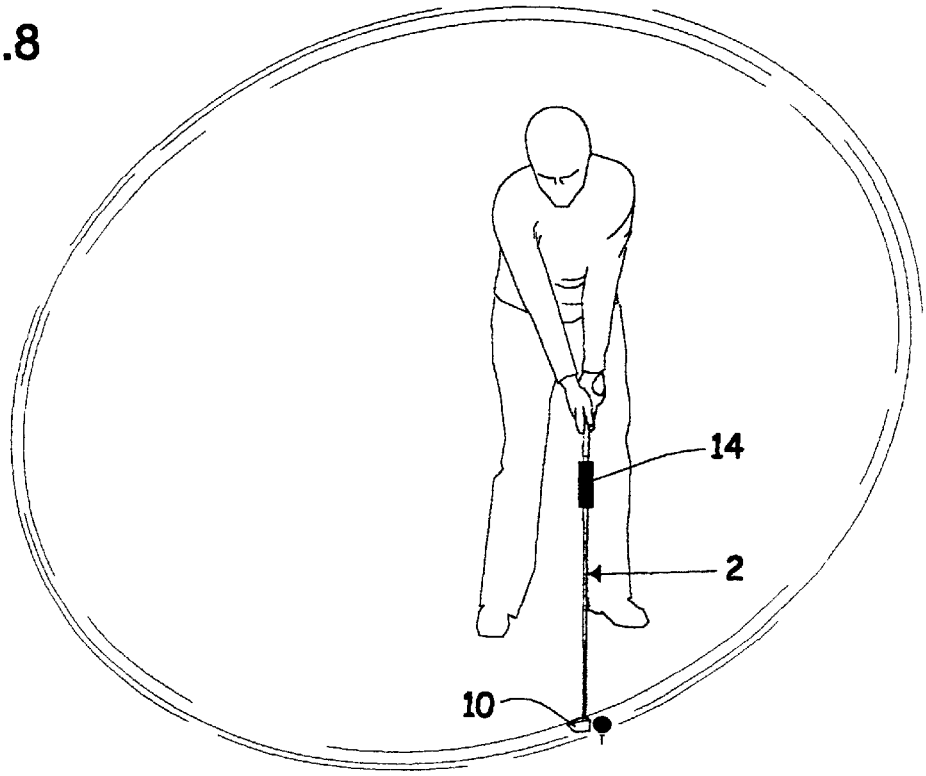
FIGS. 8 and 9 show how a one joint golf club of the present invention operates.
Figure 9:
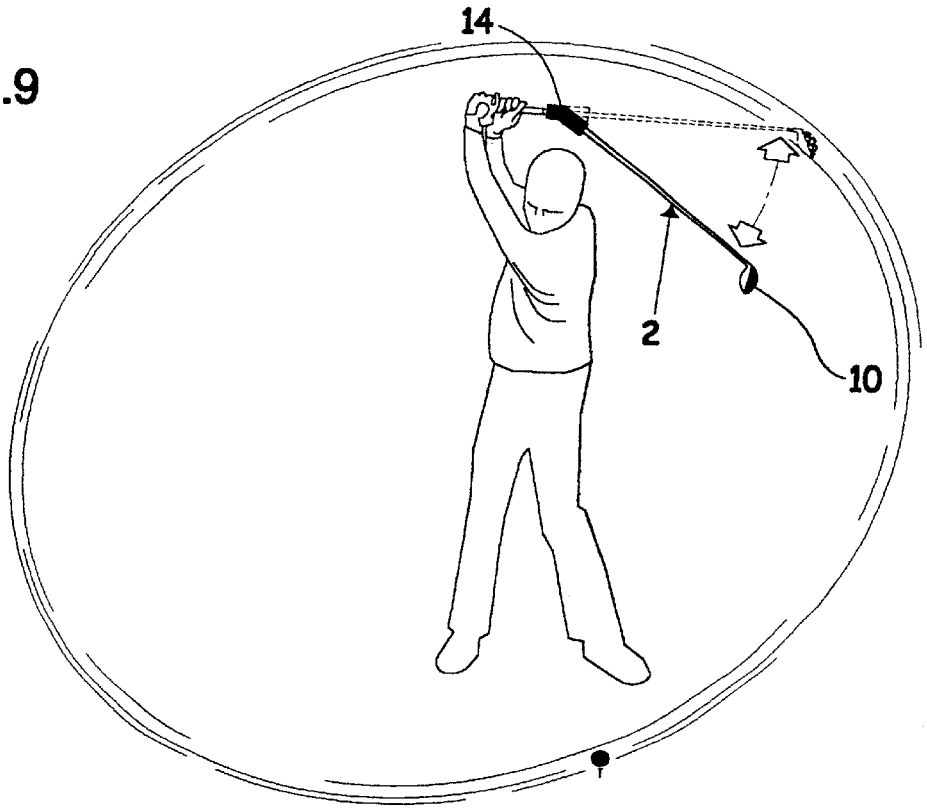

FIG. 8 shows the golfer with the golf club at address position and FIG. 9 shows the golf club being broken at the top of the back swing with the lower shaft section hanging down under gravity. Obviously, means could be provided to adjust the orientation of the swivel joint 14 with respect to the 0° loft reference plane of the ball striking face 12 of the club head 2 to suit the individual player.

Figure 8A:
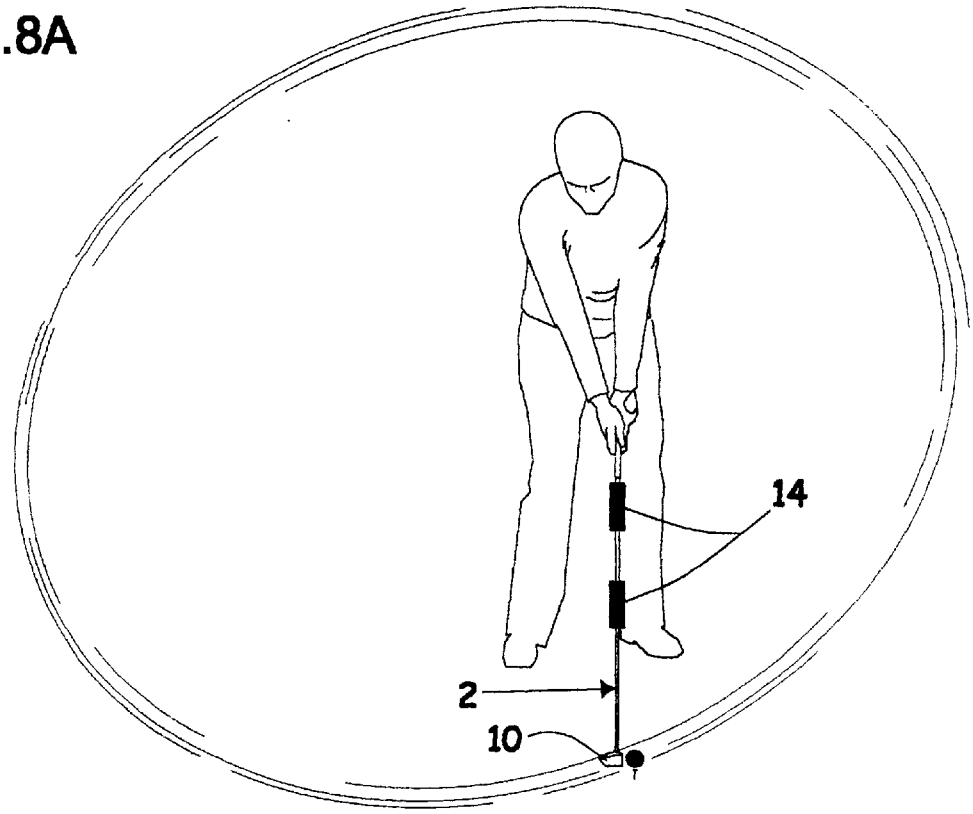
FIGS. 8*a* and 9*a* show how a two joint golf club of the present invention operates.
Figure 9A:
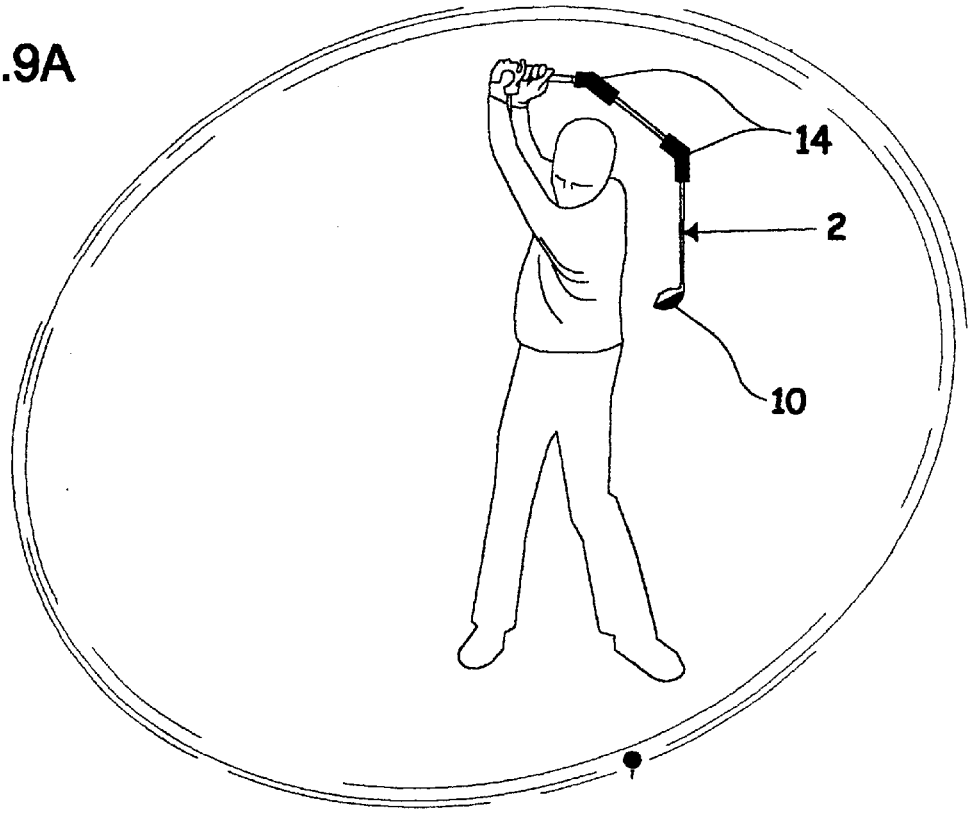

FIGS. 8*a* and 9*a* show a golf club with two joints 14 spaced along the shaft. The two joints have the same orientation relative to club head face 12 so that the three shaft sections remain coplanar when the two joints break. Club head 10 will hit the ball with a still greater force.

It is noted that the swivel joint of the invention is designed to break at every golf swing whether the wrists are properly positioned or not. When the wrists are not properly positioned, since the swivel joint exerts a greater resistance to flexing in the planes progressively angularly spaced from the 45° flexing plane the reaction forces exerted on the player's wrists by band 20 tend to rotate hand grip 6 to the correct wrist position at the top of the back swing or during the forward swing. Even if the wrists are improperly positioned, the joint will brake so that the lower shaft section will hang downward under gravity at the top of the back swing to achieve a whipping effect during the forward swing.

Normally, when golf club 2 is at the stationary address position (FIG. 8) the residual tension force exerted by the elastic band 20 on the two swivel members 16 and 18 is sufficient to keep these members, consequently, the two shaft sections 4 and 8 in alignment. However, means may be provided, if found necessary, to assist in keeping the two shaft sections in alignment when the golf club is at rest with the club head 10 lowermost.

Figure 3A:
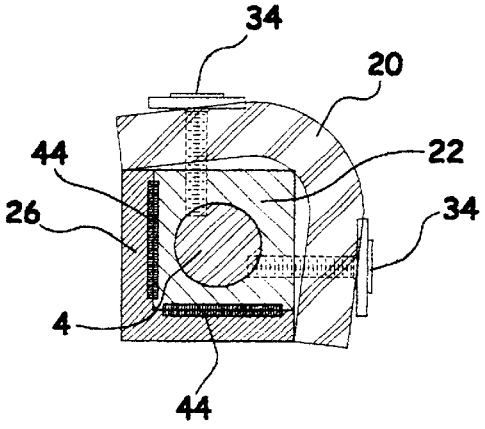
FIGS. 3*a* and 3*b* are cross-sections taken along line 3*a*—3*a* of FIG. 1*a* showing alternate additions to the joint of FIGS. 1*a* to 3.

FIG. 3*a* shows a first embodiment of these alignment retaining means, which simply consist of hook and loop fastener pads shown at 44 respectively secured to the inside of the two flanges 28 and to the four-sided block 32. The two swivel members 16, 18 are releasably retained in alignment by the hook and loop fastener 44, but they brake when at the top of the back swing since the breaking force exerted on the joint is then much greater than the retaining force exerted by the fastener 44.

Figure 3B:
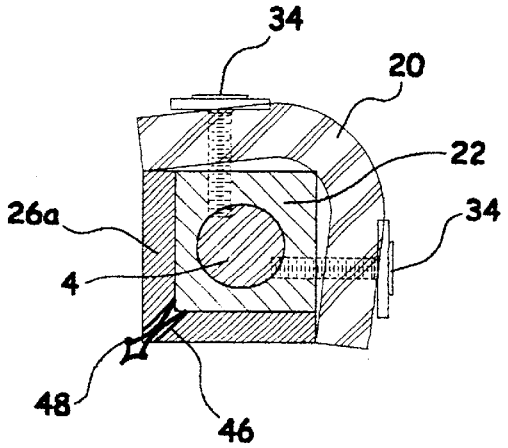
Figure 4:
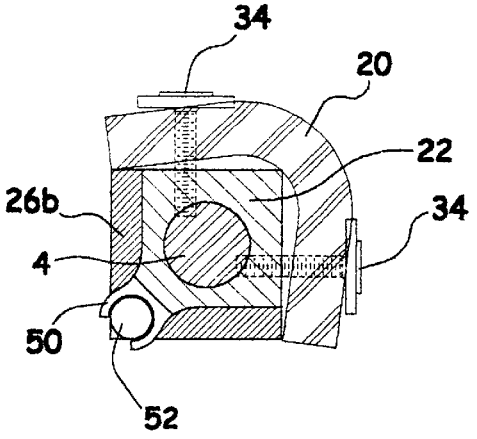
FIG. 4 is a cross-section taken along line 3*a*—3*a* of FIG. 1*a* showing yet, another modification of the joint of FIGS. 1*a* to 3.

FIG. 3*b* shows another embodiment of such a retaining device which consists simply of a slot 46 made in the ridge of the L shape stop member 26*a* for resiliently engaging a male spring clip 48 protruding from a registering corner of the four-sided block 32.

Figure 6:
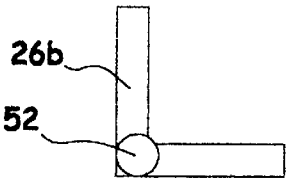
FIGS. 5, 6 and 7 are an elevation and end views respectively of the modified joint components in accordance with FIG. 4.
Figure 5:
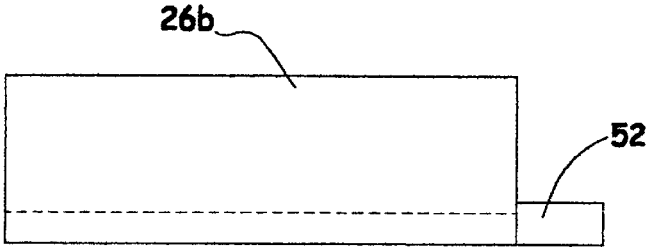
Figure 7:
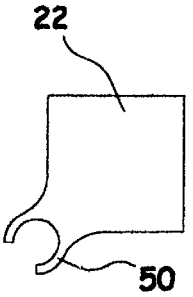

FIGS. 4, 5, 6 and 7 show a third embodiment of such a retaining device which consists simply of a female spring clip 50 protruding from a corner of the four-sided block 32 and adapted to resiliently snap onto a stud 52 protruding from the free end of the L shape stop member 26*b* as shown in FIGS. 5 and 6.

FIGS. 10 and 11 show still another embodiment of a swivel joint in accordance with the invention. This joint comprises an upper swivel member 54 and a lower swivel member 56 connected together by an elastic rod-like member 58. Upper swivel member 54 comprises a sleeve 60 having an axial blind bore 62 for tightly and securely receiving the upper shaft section 4. The sleeve 60 is extended by a stop member 64 forming two flanges 66 normal to each other. Lower swivel member 56 is formed by a sleeve 68 with an axial blind bore 69 for tightly receiving and securing to the upper end of the lower shaft section 8. Sleeve 68 is extended by a four-sided block 70 sized to abut against the two flanges 66 when the two swivel members 54, 56 are in alignment. Swivel member 54 has a cavity 72 opening within the stop member 64 while the lower swivel member 56 has a cavity 74 which is coaxial with and is aligned with cavity 72 when the two swivel members 54, 56 are in alignment. The rod-like elastic member 58 is attached at each end to the respective swivel members being inserted within the cavities 72 and 74 and attached therein by transverse attachment pins 76 extending through holes 78 across cavities 72, 74. Rod-like member 58 has preferably cylindrical cross-section with a smaller diameter end section 80 extending within cavity 74. However, the cross-sectional shape of the elastic member 58 could be other than cylindrical, for instance, a rectangular shape with its longitudinal axis diagonally of the L shape stop member 64 so as to provide greater flexing facility at 45° to the two flanges 66 of stop member 64 as in the previous main embodoment.

The second main embodiment could be further provided with any of the retaining means shown in FIGS. 3*a*, 3*b* and 4 to 7 inclusive.

In comparative tests made with a conventional golf club and the golf club in accordance with the first embodiment have shown that the distance a golf ball driven by a one wood is increased by about 15%. Moreover, it has been found that the ball is regularly driven in a much more accurate direction than with a conventional golf club, this no doubt due to the rotational reaction forces imparted to the wrists to bring them to the correct position during the down swing if such a position is not already taken by the golfer. Correct wrist position decreases the possibility of effecting accidental slices and hooks. The joint of the invention could be located nearer club head 10 than shown. The golf club shaft could be made of more than two shaft sections joined by the required number of swivel joints 14 or 54, 56, 58 to achieve a still greater whipping effect.

A fishing rod for casting or fly fishing could be made of two sections, a hand grip and reel carrying section connected to a fishing lure propelling section by the joint of the invention to further accelerate the lure during the forward stroke. The elastic band 20 or elastic member 58 can be replaced by another suitable type of resilient member.

I claim:

1. A sport implement comprising a shaft having one end, a hand grip formed around the other end of said shaft, said shaft divided into at least a first and a second shaft section, a flexible joint joining said first and second shaft sections, said joint including a first and a second connector member secured to said first and second shaft sections respectively, an abutment member defining two flaring flanges and extending from and secured to said first connector member, said second connector member fitting into said abutment member when said first and said second shaft sections are aligned, and a resilient member interconnecting said two connector members, allowing under the effect of gravity exerted on said second shaft section pivoting of said second connector member in any plane away from said two flanges and biasing said first and second connector members to said aligned position of said shaft sections.

2. A sport implement as defined in claim 1, wherein said resilient member imparts a whipping effect to said second shaft section during a forward swing movement of said first shaft section.

3. A sport implement as defined in claim 2, wherein said flanges are normal to each other and each of said first and second connector members consists of a four-sided sleeve with two adjacent sides of said second connector member abutting said flanges when said first and second shaft sections are aligned, and wherein said resilient member is an elastic sheet longitudinally folded, covering and secured to the two remaining adjacent sides of said first and second connector members, said elastic member being tensioned to a lesser degree when said second connector member is pivoted relative to said first connector member in a plane at 45° to said two flanges then in planes normal to said two flanges, whereby said flexible joint has a maximum flexibility in said 45° plane.

4. A golf club comprising a shaft, a club head secured to one end of said shaft and having a golf ball striking face and a hand grip formed around the other end of said shaft, said shaft divided into at least a first and a second shaft section, a flexible joint joining said first and second shaft sections, said joint including a first and a second connector member secured to said first and second shaft sections respectively, an abutment member defining two flaring flanges and extending from and secured to said first connector member, said second connector member fitting into said abutment member when said first and second shaft sections are in aligned position and a resilient member interconnecting said two connector members and allowing under the effect of gravity exerted on said second shaft section pivoting of said second connector member in any plane away from said two flaring flanges and biasing under the absence of said effect said first and second connector members to said aligned position of said two shaft sections.

5. A golf club as defined in claim 4, wherein said flanges are normal to each other and each of said first and second connector members consists of a four-sided sleeve with two adjacent sides of said second connector member abutting said flanges when said first and second shaft sections are aligned, and wherein said resilient member is an elastic sheet longitudinally folded, covering and secured to the two remaining adjacent sides of said first and second connector members, said elastic member being tensioned to a lesser degree when said second connector member is pivoted relative to said first connector member in a plane at 45° to said two flanges then in planes normal to said two flanges, whereby said flexible joint has a maximum flexibility in said 45° plane.

6. A golf club as defined in claim 4 wherein said resilient member in an elastomeric member.

7. A golf club as defined in claim 6, wherein said elastomeric member is a rod like elastomeric member secured at both ends to said connector members and housed therein when said connector members are aligned.

8. A golf club as defined in claim 7, wherein each connector member has two separate aligned cavities respectively surrounding and receiving a shaft section and an end portion of said rod like elastomeric member.

9. A golf club as defined in claim 4, wherein said first shaft section is shorter including said hand grip than said second shaft section with said club head carried thereby, said flexible joint being adjacent to said hand grip.

10. A golf club as defined in claim 9, wherein second shaft section is most easily pivotable in a plane of approximately 45° relative to a reference plane, said reference plane corresponding to the plane in which the striking face of said club head with a 0° loft would lie.

11. A golf club as defined in claim 4, wherein said shaft is further divided to form a third shaft section and further including a second flexible joint joining said second and third shaft sections, said second flexible joint oriented to break in the same plane as said first named joint.

* * * * *